United States Patent [19]

Spector

[11] Patent Number: 4,714,984

[45] Date of Patent: Dec. 22, 1987

[54] NIGHT LIGHT ASSEMBLY

[76] Inventor: Donald Spector, 380 Mountain Rd., Union City, N.J. 07087

[21] Appl. No.: 903,153

[22] Filed: Sep. 3, 1986

[51] Int. Cl.[4] ..... F21V 33/00

[52] U.S. Cl. ..... 362/101; 362/226; 428/905

[58] Field of Search ..... 362/96, 276, 101, 253, 362/800; 40/406, 407, 452, 489, 575, 594; 239/55, 56; 428/13, 905; 422/125

[56] References Cited

U.S. PATENT DOCUMENTS

| | | | |
|---|---|---|---|
| 1,981,650 | 11/1934 | Larsen | 362/101 |
| 2,303,073 | 11/1942 | Brown | 428/905 |
| 2,577,320 | 12/1951 | Fenyo | 40/407 |
| 2,586,039 | 2/1952 | Hegg et al. | 40/594 |
| 3,203,126 | 8/1965 | Eliot | 362/226 |
| 3,443,083 | 5/1969 | Curran | 362/101 |
| 4,346,059 | 8/1982 | Spector | 428/905 |
| 4,544,592 | 10/1985 | Spector | 428/905 |
| 4,549,250 | 10/1985 | Spector | 362/101 |

*Primary Examiner*—William A. Cuchlinski, Jr.
*Assistant Examiner*—D. M. Cox
*Attorney, Agent, or Firm*—Michael Ebert

[57] ABSTRACT

A night light assembly which plugs into and is supported by an electrical wall outlet whose orientation on the wall is either horizontal or vertical. The assembly, when switched on, produces low-level illumination and at the same time exudes an aromatic vapor. The assembly includes a reflector shell having housed therein a low-wattage bulb. Attached to the open front of the shell is a frame adapted to accommodate a removable window cartridge having a transparent plate whose rear face is covered by a thin pad of light-permeable porous material impregnated with a volatile aromatic liquid. The shell is vented, and as the air therein is heated and expanded by heat emanating from the bulb, a convection current is produced which flows across the pad to volatilize the liquid, thereby creating an aromatic vapor that is discharged through the vent. Adherable to the front face of the window plate is a translucent sheet having a picture thereon of an object possessing a characteristic odor, the fragrance of the aromatic vapor being thematically related thereto. The sheet is so adhered to the plate as to orient the picture thereon to conform to the existing orientation of the outlet into which the assembly is plugged.

7 Claims, 9 Drawing Figures

Fig. 4.
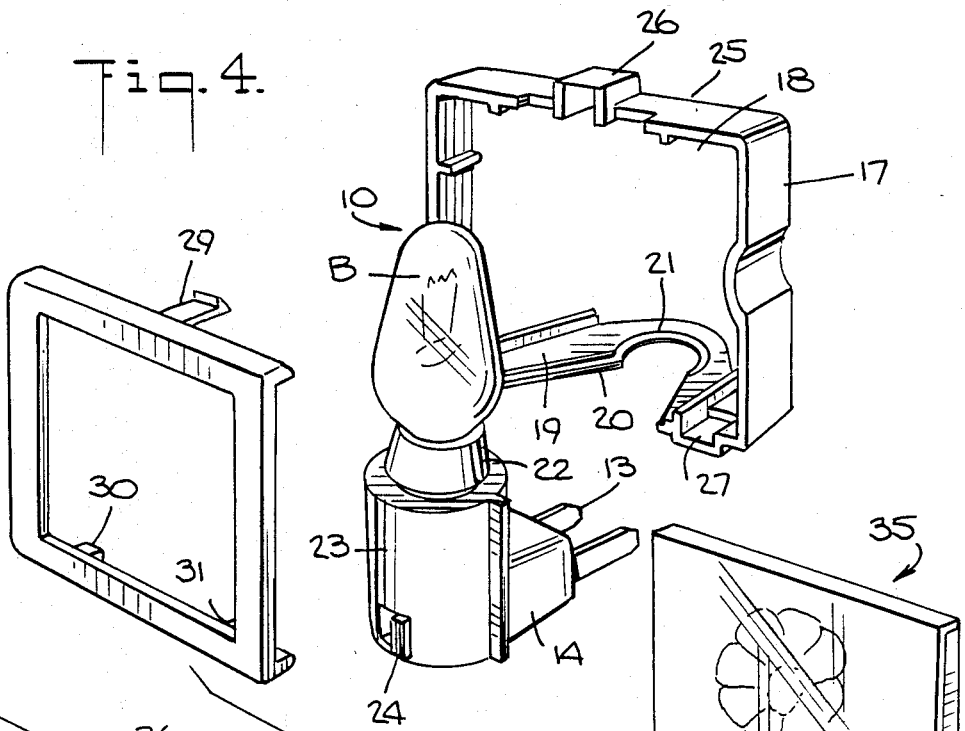
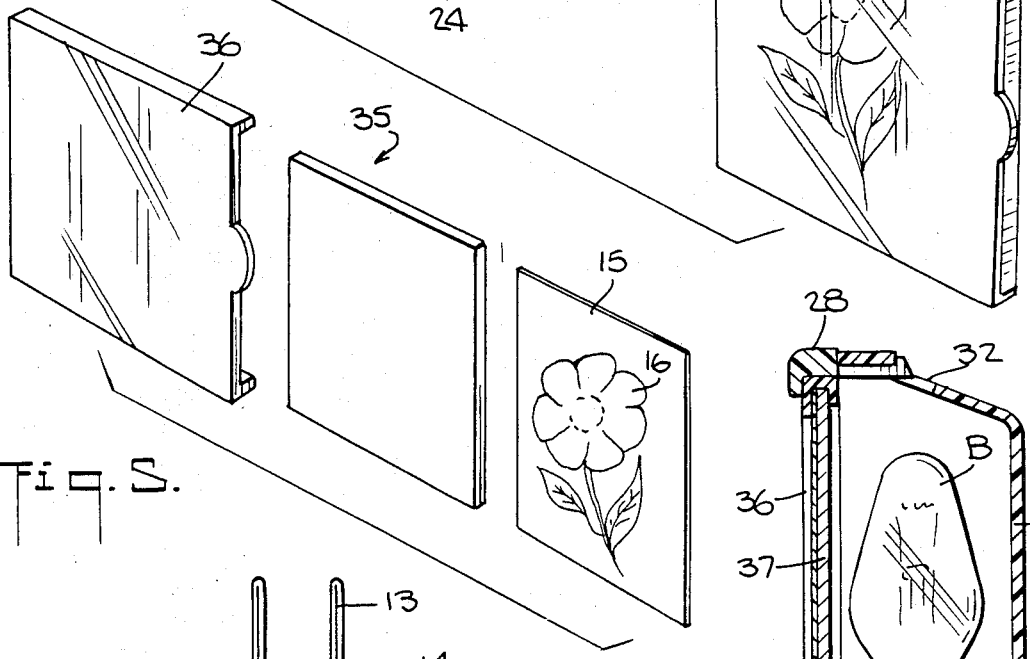
Fig. 5.
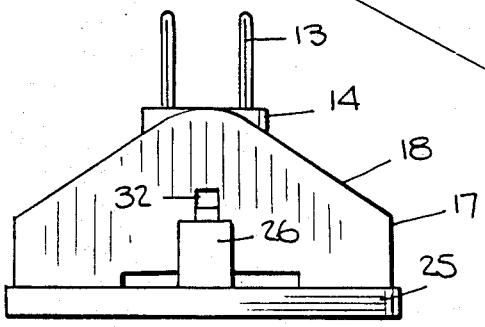
Fig. 7.
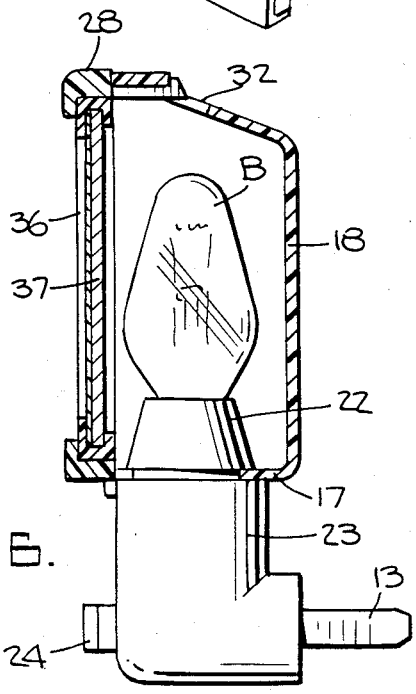
Fig. 6.

NIGHT LIGHT ASSEMBLY

BACKGROUND OF INVENTION

1. Field of Invention

This invention relates generally to night lights to provide low-level illumination in a room or passageway, and more particularly to a night light assembly which carries a picture of an object having a characteristic odor, the picture being illuminated by the light, the assembly also exuding an aromatic vapor whose fragrance is thematically related to the pictured object.

2. State of the Art

A bedroom which is excessively bright or which has a disagreeable odor is not conducive to sleep. Hence in considering the sleeping conditions of a room, one must not only seek to minimize noise and other disturbances, but one must also arrange for the proper degree of lighting and take steps to ensure a pleasing atmosphere.

A totally dark room is not the ideal environment for sleeping, for it may be psychologically depressing to the occupant. Moreover, should the sleeper awaken and then move about the dark room, he may collide with furniture and other articles therein. Where the sleeping room is a child's nursery, a minimum degree of light is desirable. Young children are often fearful of complete darkness; and should a parent wish to check on the sleeping child without turning on the room light, a low-level night light which is already "on" is useful for this purpose.

The prevailing atmosphere of a room is a more subtle factor in regard to sleep. However well cleaned a room, if it has carpeting, draperies or other fabrics, these tend to retain odors such as stale tobacco smoke. Hence it is often the practice to make use in bedrooms or nurseries of commercially available air fresheners.

The conventional night light consists of an electrical socket which is integrated with a plug to be inserted into an electrical wall outlet, a low-wattage bulb being held in the socket which also supports a small shade. A night light of this type which provides low-level illumination is purely utilitarian in function and appearance, and it makes no useful or decorative contribution to the room apart from low-level illumination.

The use of light bulbs to illuminate a picture slide is commonplace, for all commercial slide projectors include a light bulb to supply the required light. And the use of light bulbs as heat sources to volatilize an aromatic liquid held in a pan or impregnating a porous pad is also well known, as evidenced by the patents to Eisner U.S. Pat. No. 2,374,371; Gudeman, U.S. Pat. No. 1,403,648, and Schlesinger, U.S. Pat. No. 2,435,757.

In my prior U.S. Pat. No. 4,549,250 (1985) there is disclosed a night light assembly which plugs directly into an electrical wall outlet to provide low level illumination while at the same time generating an aromatic vapor whose odor is thematically related to a replaceable picture slide incorporated in the assembly and illuminated thereby.

The assembly includes a shell supported by a plug projecting from its rear and insertable into the wall outlet. Housed in the shell is a low-wattage bulb, the shell being covered by a removable frame within which is nested the picture slide to be illuminated. Coated on the rear face of the slide is a translucent layer having a volatile aromatic liquid dispersed therein. The shell is vented, and as the air in the shell is heated and expanded by heat arising from the bulb, a convection current is produced which passes across the slide layer to volatilize the liquid, thereby creating an aromatic vapor which is discharged through the vent into the atmosphere.

There are several practical drawbacks in the night light assembly disclosed in my prior art patent. When illuminated by the bulb, the picture slide is then clearly visible and attractive. But when the bulb is turned off, as is usually the case during daytime hours, then the slide, as with conventional photographic slides, assumes a dull gray color. Thus, one looking at the switched-off night light assembly sees no picture but only a dark slide, so that the night light assembly then has a rather unattractive appearance.

The more serious drawback of my prior night light assembly is that the orientation of the slide depends on the orientation of the electrical wall outlet into which the assembly is plugged, and this orientation is not consistent and varies from outlet to outlet.

The typical electrical plug has a parallel pair of flat metal prongs and these go into the complementary connector openings in the wall outlet. These connector openings in many cases lie in the vertical plane, and in other instances lie in the horizontal plane, depending on how the outlet is installed. Hence when the plug of the night light assembly is inserted in the outlet, the assembly will have a vertical orientation or a horizontal orientation, depending on the existing outlet installation.

In my prior patented arrangement, the picture slide has a predetermined orientation, and it will therefore be properly oriented only when the outlet has the same orientation. If, therefore, the picture is that of a tree which has a vertical orientation, the tree will appear to be horizontal in the event the outlet has a horizontal orientation.

Another problem in my prior arrangement wherein a gel having a volatile aromatic liquid dispersed therein is coated on the rear surface of a picture slide is that this combination does not have an indefinite shelf life. Thus, if this slide is stored for a prolonged period, there may be an adverse interaction between the gel and the slide.

Of background interest are the following U.S. Pat. Nos.:

3,248,530, 4/1966, Titmas
3,443,083, 5/1969, Curran
3,531,635, 9/1970, Hancock
3,780,260, 12/1973, Elsner
4,070,777, 1/1978, LoGiudice
4,072,855, 2/1978, Marchese
4,163,998, 8/1979, Anderson et al.
4,493,011, 1/1075, Spector

SUMMARY OF INVENTION

In view of the foregoing, the main object of this invention is to provide an improved night light assembly which plugs into an electrical wall outlet to produce low-level illumination while at the same time generating an aromatic vapor whose fragrance is thematically related to a picture of an object having a characteristic odor, the picture being adherable to the transparent plate of a fragrance-generating window cartridge included in the assembly.

More particularly, an object of this invention is to provide a window cartridge of the above type which is insertable into the assembly and which may readily be replaced when the fragrance source is exhausted or when one wishes to change the picture presentation and its thematically related odor.

A significant feature of the invention is that the orientation of the picture depends on how it is adhered to the window plate and therefore can be made to conform to the orientation of the wall outlet to which the assembly is connected. Another advantage of the cartridge is that the picture and the window plate having a fragrance source associated therewith may be separately stored to prevent an adverse interaction therebetween in the course of a prolonged storage.

Also an object of the invention is to provide an assembly of the above type which may be mass produced at relatively low cost.

Briefly stated, these objects are attained in a night light assembly which plugs into and is supported by an electrical wall outlet whose orientation on the wall is either horizontal or vertical. The assembly, when switched on, produces low-level illumination and at the same time exudes an aromatic vapor. The assembly includes a reflector shell having housed therein a low-wattage bulb. Attached to the open front of the shell is a frame adapted to accommodate a removable window cartridge having a transparent plate whose rear face is covered by a thin pad of light-permeable porous material impregnated with a volatile aromatic liquid. The shell is vented, and as the air therein is heated and expanded by heat emanating from the bulb, a convection current is produced which flows across the pad to volatilize the liquid, thereby creating an aromatic vapor that is discharged through the vent. Adherable to the front face of the window plate is a translucent sheet having a picture thereon of an object possessing a characteristic odor, the fragrance of the aromatic vapor being thematically related thereto. The sheet is so adhered to the plate as to orient the picture thereon to conform to the existing orientation of the outlet into which the assembly is plugged.

OUTLINE OF DRAWINGS

For a better understanding of the invention as well as other objects and further features thereof, reference is made to the following detailed description to be read in conjunction with the accompanying drawings, wherein:

FIG. 4 is an exploded view of the night light assembly;

FIG. 5 is an exploded view of the window cartridge;

FIG. 6 is a sectional view of the assembly;

FIG. 7 is a top view of the assembly;

DESCRIPTION OF INVENTION

Figure 1:
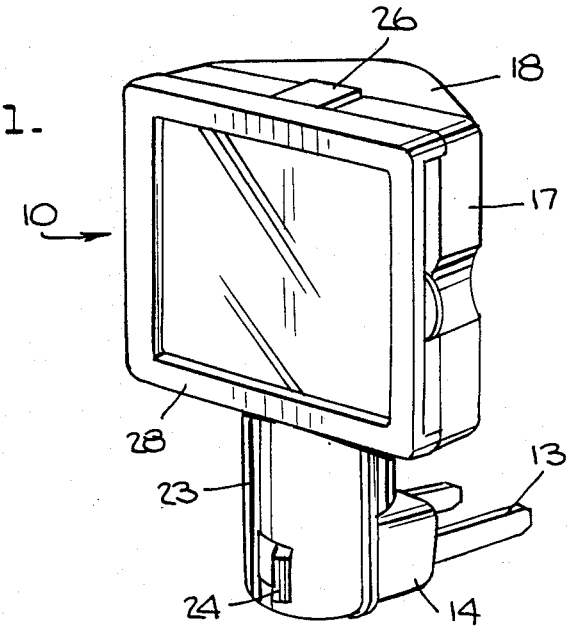
FIG. 1 is a perspective view of a night light assembly in accordance with the invention.
Figure 9:
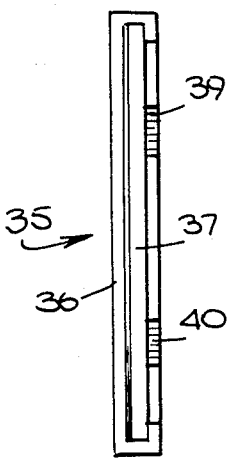
FIG. 9 is an end view of the window cartridge.
Figure 2:
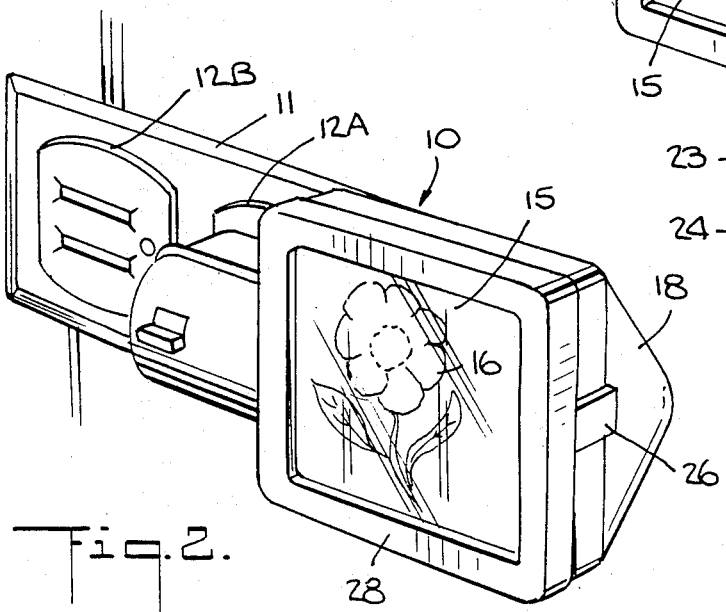
FIG. 2 shows the assembly when it is plugged into an electrical wall outlet which is horizontally oriented.
Figure 3:
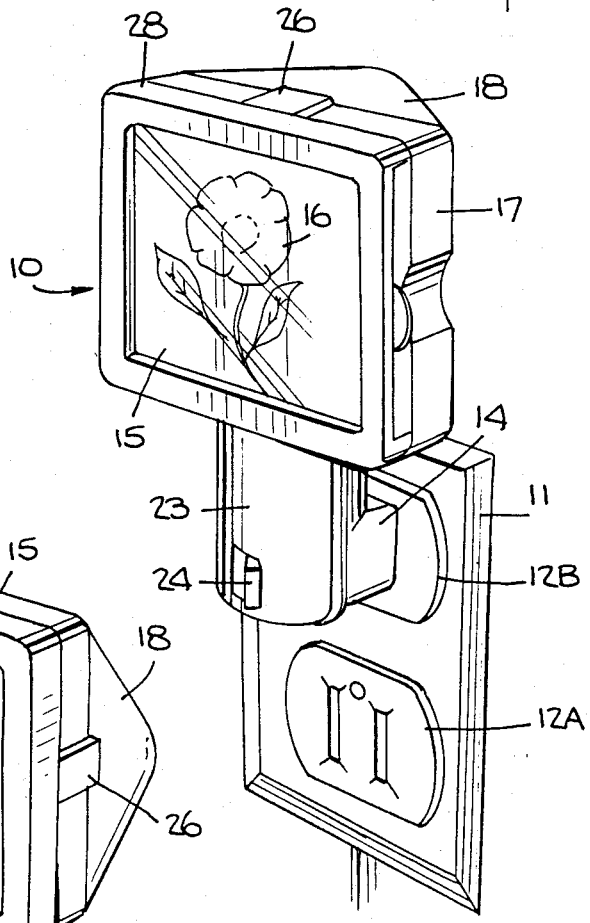
FIG. 3 shows the assembly when it is plugged into an outlet having a vertical orientation.

Referring now to FIGS. 1, 2, and 3, there is illustrated a night light assembly in accordance with the invention, generally designated by numeral 10. The assembly is plugged into one socket of a standard double socket electrical power outlet 11 located on the baseboard or on a wall in a bedroom, a nursery or any other room or passageway in which the use of a night light is needed to provide low-level illumination for reasons of safety or for any other purpose.

As shown in FIG. 2, wall outlet 11 has a pair of electrical receptacles 12A and 12B each having a pair of openings adapted to receive the flat metal prongs 13 of a plug 14 included in assembly 10. Since wall outlet 11 in this instance is so installed on the wall that it is horizontally oriented, when night light assembly 10 is plugged therein, the assembly then assumes a horizontal orientation.

In FIG. 3, the outlet installation is such that it is vertically oriented, in which case, assembly 10 when plugged into receptacle 12 of the outlet assumes a vertical orientation.

The assembly includes a sheet 15 which is adherable to the front face of a window cartridge whose structure will be later described. This sheet has a picture 16 thereon which in the example shown is that of a flower having a stem and is normally, therefore, vertically oriented. It will be seen that flower 16 in both FIGS. 2 and 3 is vertically oriented, even though in FIG. 2 the assembly is horizontally oriented. The reason for this is that sheet 15 is not adhered to the assembly until the user first sees the existing orientation of outlet 11, and he then adheres sheet 15 to the assembly to take this orientation into account when orienting the picture.

As shown in FIG. 4, included in assembly 10 is a generally rectangular shell 17 of molded synthetic plastic material having a trough-shaped rear reflector wall 18. The bottom wall 19 of the shell is provided with a wedge-shaped inlet 20 leading into an arcuate recess 21 adapted to receive a socket 22 into which is screwed a low-wattage light bulb B. Socket 22 is mounted above a cylindrical plastic case 23 from which laterally projects the plug 14. The case houses an electrical switch having an actuator 24 to turn the bulb on and off.

At the center of the top wall 25 of shell 17 is a latching socket 26 having a rectangular cross section. Provided on either side of inlet 20 on the bottom wall of the shell are a pair of latch sockets 27.

Attachable onto rectangular shell 17 is a rectangular plastic frame 28. This frame is provided at its top side with a rearwardly-projecting flexible latching element 29 that is received in latching socket 26 and at its bottom side with a pair of shorter latching elements 30 and 31 that are received in complementary latching sockets 27.

Figure 8:
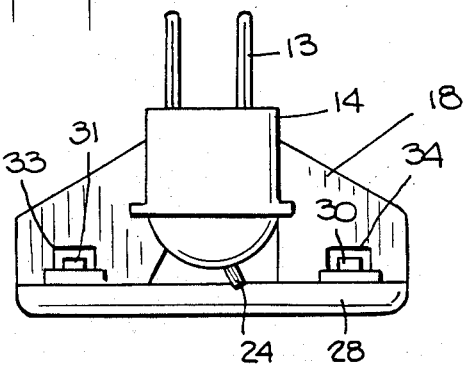
FIG. 8 is a bottom view of the assembly.

As best seen in FIGS. 6 and 7, the sloped top of the trough-shaped rear wall 18 has a vent opening 32 therein. As shown in FIG. 8, the sloped bottom of rear wall 18 is provided with vents 33 and 34 which also accommodate latching elements 30 and 31.

As shown in FIG. 4, laterally insertable into frame 28 is a rectangular window cartridge, generally identified by numeral 35. This cartridge, as best seen in FIG. 5, is constituted by a transparent plastic plate 36, three sides of which have right angle flanges thereon, the fourth side being free. Plate 36 at its free side has a protruding finger piece to facilitate insertion of the cartridge into frame 28.

Placed behind window plate 36 is a translucent mat or pad 37 of absorbent material, such as white blotting paper, non-woven fabric or foam plastic material. This pad is held in place by lugs 40 projecting inwardly from the side flanges of the window plate. The pad is impregnated with a volatile aromatic liquid to be later described.

Adhered to the front face of the window plate is the sheet 15 having a picture 16 thereon. The sheet is of translucent material and has a pressure-sensitive backing layer so that one can apply the sheet to the plate in any desired orientation to conform to the existing orientation of the wall outlet.

Shell 17 is formed of white plastic or its rear wall 18 is coated with a white or other light-reflecting layer. Thus, light emitted by bulb B is reflected by the shell to more or less uniformly irradiate translucent pad 37, the light passing therethrough back illuminating the translucent picture sheet 15. However, unlike a photographic slide, when the light bulb is turned off, picture 16 is front illuminated by ambient light in the room and still clearly visible. Hence when the night light assembly is turned off, one still sees an attractive picture.

In operation, heat emenating from the bulb gives rise to convection currents, this resulting in a continuous flow of heated air. The heated air flowing past the rear surface of pad 37 acts to volatilize the liquid impregnated therein and produces an aromatic vapor which is discharged into the atmosphere through the vent openings. This discharge also prevents overheating of the assembly, for the heated air is not confined therein.

As used herein, the term "aroma" is not limited to pleasant or savory smells, but encompasses scents that function as insecticides, air fresheners, deodorants or any other odor that acts to condition, modify or otherwise charge the atmosphere. The aroma of perfumes and perfume-based products such as colognes and toilet waters was originally derived from the essential oils of plants. However, since the early 19th century, chemists have succeeded in analyzing many essential oils and in creating thousands of synthetics, some simulating natural products and others yielding altogether new scents. Perfumes today are largely blends of natural and synthetic scents and of fixatives which equalize vaporization and enhance pungency. In most liquid scents, the ingredients are combined with alcohol.

Sheet 15, as illustrated, has a picture of a flower, and in this instance, the aromatic liquid impregnated in pad 37 is thematically related to this picture; that is, it yields the characteristic odor of the flower shown.

Carriage 15 is replaceable; and when one uses a cartridge which pictures a rose, then the aroma generated by the cartridge is that of roses. If the cartridge has a picture of a Christmas tree, then a pine-like aroma will be generated; whereas if the cartridge has a picture of strawberries, then a strawberry odor will be exuded by the assembly. Thus, whatever the theme of the picture, the aroma generated is a thematically-related odor.

Thus, the pictures in the cartridge will in all cases be of some object having a characteristic odor, and the cartridge will incorporate an aromatic liquid which when vaporized produces this odor, so that the viewer smells, as it were, what he sees.

Thus, the night light assembly is both decorative and useful, and it affords low-level illumination accompanied by an aroma thematically-related to the illuminated picture.

In practice, the cartridge, without the sheet may be packaged in a sealed plastic envelope to prevent the evaporation of fragrance before the cartridge is put to use in the night light assembly. When the cartridge is exhausted, it may be removed from the frame and replaced with a fresh cartridge.

While there has been shown and described a preferred embodiment of an improved night light assembly in accordance with the invention, it will be appreciated that many changes and modifications may be made therein without, however, departing from the essential spirit thereof.

I claim:

1. A night light assembly which plugs into and is supported by an electrical wall outlet whose existing orientation is either horizontal or vertical, said assembly comprising:

A. a reflector shell having a vent therein and an open front;

B. a low-wattage bulb housed in said shell and held in a socket mounted on a case attached to the underside of the shell, said case having a plug projecting therefrom provided with prongs which are insertable into said outlet to supply power to the bulb whereby the resultant light is directed toward the open front;

C. a frame secured to the open front of the shell adapted to accommodate a window cartridge; and D. a removable window cartridge insertable in said frame, said cartridge being constituted by a transparent window which covers the open front of the shell, a pad of porous material placed behind the rear face of the plate and formed of a material permeable to said light, said pad being impregnated with a volatile aromatic liquid; and a sheet of translucent material adherable to the front face of the plate and having a picture thereon, said sheet being adhered to the plate so that the orientation of the picture is consistent with the existing orientation of the outlet, whereby when the bulb is powered, it back illuminates the picture which, in the absence of such illumination, is rendered visible by front ambient light illumination, the head from the powered bulb volatilizing the liquid to produce an aromatic vapor which is discharged through said vent.

2. The assembly as set forth in claim 1, wherein said picture has a given theme, and said liquid produces an aroma thematically related thereto.

3. An assembly as set forth in claim 1, wherein said picture is that of a given flower having a characteristic odor and said aroma simulates said odor.

4. An assembly as set forth in claim 1, wherein said case is provided with a switch interposed between the bulb and the plug.

5. An assembly as set forth in claim 1, wherein said shell has a trough-like rear wall acting as a light reflector.

6. An assembly as set forth in claim 1, wherein said transparent window is formed of clear plastic material.

7. An assembly as set forth in claim 1, wherein said pad is formed of white blotting paper.

* * * * *